US008225848B2

(12) United States Patent
Cottard et al.

(10) Patent No.: US 8,225,848 B2
(45) Date of Patent: Jul. 24, 2012

(54) DEVICE FOR REDUCING FOULING IN A TUBULAR HEAT EXCHANGER

(75) Inventors: Bernard Cottard, Saint Romain de Colbosc (FR); Emmanuelle Petitjean, Saint Avold (FR)

(73) Assignee: Total Raffinage Marketing, Puteaux (FR)

( * ) Notice: Subject to any disclaimer, the term of this patent is extended or adjusted under 35 U.S.C. 154(b) by 950 days.

(21) Appl. No.: 12/065,212

(22) PCT Filed: Aug. 23, 2006

(86) PCT No.: PCT/FR2006/001970

§ 371 (c)(1),
(2), (4) Date: Feb. 28, 2008

(87) PCT Pub. No.: WO2007/026066

PCT Pub. Date: Mar. 8, 2007

(65) Prior Publication Data

US 2008/0202728 A1 Aug. 28, 2008

(30) Foreign Application Priority Data

Aug. 30, 2005 (FR) ..... 05 08867

(51) Int. Cl.
*F28G 1/12* (2006.01)
*B08B 1/00* (2006.01)

(52) U.S. Cl. ..... 165/95; 165/85

(58) Field of Classification Search ..... 165/94, 165/95, 85, 109.1; 134/22.11; 138/38; 15/104.03, 15/104.05, 104.061, 104.062, 104.067, 104.069
See application file for complete search history.

(56) References Cited

U.S. PATENT DOCUMENTS

| | | | | | |
|---|---|---|---|---|---|
| 1,809,725 | A | * | 6/1931 | Roe | 15/206 |
| 2,465,396 | A | * | 3/1949 | Peterson et al. | 15/206 |
| 2,532,179 | A | * | 11/1950 | Miller | 165/95 |
| 3,407,871 | A | * | 10/1968 | Penney | 165/85 |
| 4,174,750 | A | | 11/1979 | Nichols | |
| 4,340,989 | A | * | 7/1982 | Rotondi et al. | 15/104.067 |
| 4,545,426 | A | * | 10/1985 | Collins | 165/95 |
| 4,718,480 | A | * | 1/1988 | Kito et al. | 165/94 |
| 4,781,245 | A | | 11/1988 | Freychet et al. | |
| 4,825,940 | A | * | 5/1989 | Barroyer et al. | 165/84 |
| 4,848,446 | A | | 7/1989 | Freychet et al. | |
| 5,013,368 | A | | 5/1991 | Maroy et al. | |
| 5,799,622 | A | * | 9/1998 | Waldner | 122/387 |

FOREIGN PATENT DOCUMENTS

| | | |
|---|---|---|
| EP | 0 174 254 A1 | 3/1986 |
| FR | 2 637 659 A1 | 4/1990 |

* cited by examiner

*Primary Examiner* — Tho V Duong
(74) *Attorney, Agent, or Firm* — Sughrue Mion, PLLC

(57) ABSTRACT

The invention relates to a device for reducing fouling in a tube (1) through which a fluid passes. The inventive device comprises a mobile rotary element (3) and a fixed bearing-forming element (2) which can be solidly connected to the upstream end of the tube (1). In addition, the mobile element (3), which is connected to the fixed element (2), comprises an upstream trunnion-forming part (4) and a downstream turbulence-generating part (5) which is shaped such as to be rotated by the flow of the fluid in the tube (1). The aforementioned upstream (4) and downstream (5) parts are connected to one another by means of an elongated flexible connector (6) that is deformable along the entire length thereof.

20 Claims, 1 Drawing Sheet

DEVICE FOR REDUCING FOULING IN A TUBULAR HEAT EXCHANGER

BACKGROUND OF THE INVENTION

The present invention relates to a novel device for reducing the fouling of tubes in which a fluid flows, particularly tubes of a heat exchanger, of the type comprising a rotating turbulence-generating element, and used in industry, the petroleum or petrochemical industry in particular.

For some 20 years, devices have been known, installed so as to rotate freely inside tubes of heat exchangers, for the purpose of preventing the potential fouling due, for example, to impurities in suspension or to deposits of inorganic salts dissolved in the fluid, to coke undergoing formation in a thermal cracking process, or to sulfur-containing species soluble in hydrocarbons. Said impurities or said coke which, in certain temperature and pressure conditions, tend to deposit on the inside walls of the lines conveying the fluid, thereby cause flow obstructions which are detrimental to the operation of the process located downstream or, more seriously, hot spots on the inside surface of the tube, possibly leading to damage to its metal structure and thereby causing leaks of products.

Such devices are described for example in applications EP 0 174 254, EP 0 233 092, FR 2 637 659, EP 0 282 406, EP 0 369 851 and EP 1 227 292 filed by the Applicant. They have in common a mobile element, generally helix shaped, fixed to the upstream end of the tube so as to rotate freely therein under the action of the fluid flow. In the devices described in the abovementioned documents, the dimensions of the mobile element and of the interior of the tube are such that the mobile element does not scrape the inside wall of the tube continuously, in order to avoid any harmful effects on the service life of the tube and/or of the mobile element. The effect of reducing the fouling of the tubes is mainly due to the increase in the turbulence of the fluid, which prevents the formation of hot spots and the formation of deposits, thanks to a thermal homogenization effect, and also to a high shear effect close to the wall, which serves to detach deposits that are weakly attached to said wall.

In application EP 0 369 851, the Applicant further describes a mobile element comprising, in all its cross sections, at least one sharp edge shaped specifically so as to scrape the inside surface of the tube.

The only vulnerable point of the prior art devices is their fastening system, and, more precisely, the trunnion whereby the mobile element is retained in its fixed portion serving for fastening the device to the upstream end of the tube. In fact, the mobile element, which may be several meters long, and which is rotated by the fluid, is generally several scores of times greater and heavier than the trunnion, thereby exerting thereon a considerable tensile force. This tensile force, combined with high speeds of rotation of about 500 to 2000 revolutions per minute, exposes the fastening system to high friction, causing rapid wear of the moving parts.

The fastening systems used today in refinery heat exchangers have an average service life of between 12 and 36 months. It is obviously desirable to lengthen this period, because the replacement of these systems demands the opening of the heat exchanger, possibly requiring a complete shutdown of the installation in which it operates, and automatically incurring expenses and a loss of income to the operator.

SUMMARY OF THE INVENTION

The Applicant has consequently undertaken research aimed at better understanding and at overcoming the problems of wear of the metal parts forming the known systems for attaching rotating mobile elements in tubes conveying a fluid. These researches have demonstrated that the wear effects were observed most strongly at the trunnion, and in particular at the locations where said trunnion was in friction contact with sharp edges of the bearing or of a friction washer, optionally present. This wear profile is attributed to the fact that the mobile element, which is rotated by the fluid and which generally has an outside diameter that is smaller than the inside diameter of the tube, dislodges the trunnion from its axis of rotation and forces it to rotate in a cone of revolution pattern.

The Applicant has also found that the first turn or turns of the helix are also worn, despite the fact that they have a smaller outside diameter than the inside diameter of the tube, which should, in principle, prevent any friction against the tube wall.

The Applicant therefore focused on reducing the friction and wear described above as much as possible, in order to significantly lengthen the service life of the fastening systems bearing the mobile elements of known cleaning devices. This purpose was achieved by a fastening system that comprises a flexible connector connecting the trunnion of the mobile element to the generally helical portion extending along part of the tube and rotated by the fluid flow.

The object of the present invention is therefore to provide a device for reducing fouling in a tube through which a fluid passes, of the type comprising at least one turbulence-generating element, said device comprising a mobile rotary element and a fixed bearing-forming element, suitable for being solidly connected to the upstream end of the tube, characterized in that:

- the mobile element connected to the fixed element comprises an upstream trunnion-forming part and a downstream turbulence-generating part, shaped so as to be rotated by the fluid flowing in the tube, and in that,
- the upstream and downstream parts are connected to one another by an elongate flexible connector deformable along its whole length.

In the context of the present invention, "flexible" connector generally means a connector "which can be bent and rebent easily without breaking or deteriorating" (cf. Le Nouveau Petit Robert, June 2000 Edition) having the meaning "elastic, bendable, workable".

A further subject of the invention is a heat exchanger comprising a plurality of tubes through which a fluid passes, characterized in that a fouling reducing device is fixed to the upstream end of at least one of said tubes.

The flexible connector between the trunnion and the helical part rotated by the fluid permits a certain "uncoupling" of these two parts. While they obviously rotate, always at the same speed as one another, the dislodging force that the helical part previously exerted on the downstream end of the trunnion is substantially reduced, because it is now damped by the whole length of the connector. In the flexible connector fastening systems according to the invention, the cone of revolution described by the trunnion is consequently reduced to the minimum, or is even nonexistent, and the trunnion rotates substantially parallel to the geometric axis of the tube.

The flexible connector used in the present invention may be made from any material provided that it has sufficient chemical resistance and mechanical strength in the operating conditions of the device. The flexible connector is preferably made from metal, preferably steel, and from stainless steel in particular, or from plastic, carbon fibers, synthetic fibers, from elastomer, or from a composite material comprising a combination of a plurality of these materials.

The flexible connector may, for example, be a cable formed of braided or twisted strands, a chain formed of interlacing rings, or even a ringed tube formed of a succession of rings hinged to one another.

When the flexible coupling is of the braided or twisted cable type, it preferably comprises a number of strands of between 1 and 100 and preferably between 1 and 50.

For a mobile element 10 meters long, a flexible connector is preferred having a length of between 1 cm and 5 cm, and preferably between 2 and 4 cm. Its diameter should be between 2 and 10 mm and preferably between 4 and 8 mm.

Said flexible connector is fixed between the downstream end of the trunnion and the upstream end of the rotated part. The connection to these two parts can be made by techniques known per se, for example by welding, crimping or screwing, or even by adhesive bonding.

The rotated part may, in principle, have any appropriate asymmetrical shape enabling the fluid that flows through the tube to rotate it about the axis of said tube. The most efficient shape, creating maximum turbulence for minimum pressure drop, is the helix, which is accordingly used in nearly all devices of the type described in the introduction, and is also preferred for the present invention.

This helix must have an outside diameter smaller than the inside diameter of the tube to avoid continuously scraping the inside wall thereof. The outside diameter of the helix must nevertheless be sufficiently close to the inside diameter of the tube to create, in addition to the turbulence, sufficient shear forces close to the tube surface, to detach deposits or particles weakly fixed to the wall. Satisfactory turbulence and shear effects are generally obtained for systems in which the ratio of the outside diameter of the helix to the inside diameter of the tube is between 0.5 and 0.9, and preferably between 0.6 and 0.8.

Ratios lying between the above ranges have proved to be sufficiently low to prevent any friction contact between the tube and the helix along nearly the whole length thereof, with the exception of the location of the first turn(s) of the helix. As stated above, the Applicant has found in fact that, for ratios of the outside diameter of the helix to the inside diameter of the tube lying within the ranges indicated above, at least the first turn of the helix, and sometimes also the next two or three turns, could present traces of wear by friction. Although this effect is lesser for the flexible connector fastening systems as described in the present application, it may nevertheless persist in certain operating conditions of the device according to the invention. This problem was solved thanks to the use of a helix in which the outside diameter of the first turn or of the first turns of the helix is smaller than the outside diameter of the other turns of the helix.

The number of "first" turns concerned by this diameter decrease is generally not more than 1 to 5% of all the turns of the helix. For these turns, the ratio of the outside diameter thereof to the inside diameter of the tube, is between 0.1 and 0.6, and preferably between 0.2 and 0.6. When a plurality of turns are concerned, their outside diameter preferably increases progressively from upstream to downstream.

The fixed bearing-forming element, designed to receive and support the trunnion, may have a wide variety of shapes, insofar as it performs two functions, which are, on the one hand, to ensure the robustness of the fastening to the end of the heat exchanger tube, and on the other, minimizing the obstructions to the fluid flow. It preferably has the shape of a cup-shaped yoke comprising a central part drilled with an orifice for receiving the trunnion of the mobile element, and two branches, symmetrical to one another, having a shape suitable for fixing them to the upstream end of the tube. This yoke shape of the bearing-forming part is known and is described for example in applications EP 0 233 092, EP 0 282 406 and EP 0 369 851 filed by the Applicant. It may, for example, be a cup-shaped yoke whereof the ends form a hollow cylinder suitable for enclosing the end of the tube, as described in EP 0 233 092, or, preferably, a yoke made from a stiff but elastic material, whereof the ends of the two branches can be forcibly engaged in the upstream end of the tube to bear elastically against the inside wall thereof. However, the invention also encompasses any other system suitable for solidly joining a bearing-forming part to the upstream end of the tube.

In a particular embodiment of the device according to the invention, the trunnion is retained in the orifice of the bearing by a first stop provided at its upstream end and connected thereto. A second tubular stop is provided on the central part of the yoke in a prolongation of the orifice suitable for receiving the trunnion of the mobile element. This second stop, joined to the bearing, performs the function of maintaining the trunnion in the axis of rotation of the mobile element and is therefore preferably relatively long. When the mobile element is rotated by the fluid passing through the tube, the first stop joined to the trunnion comes into friction contact with the second tubular stop, joined to the fixed element.

In a preferred embodiment of the device of the present invention, one or more friction washers are provided between the first stop and the second stop. This friction washer is free, that is neither joined to the mobile element nor to the fixed element. It is preferably made from a different material or has a different hardness, or even is of the antifriction type having a very low friction coefficient, generally softer than the materials of the first and second stops. Mention can be made as examples of such materials, of steels, particularly heat treated steels, copper alloys, ceramics, and graphites.

The friction washers known for example from EP 0 233 092, EP 2 637 659 and EP 0 282 406, have friction surfaces that are flat or match the friction surface of the stop. Preferably, the contact surfaces should be reduced to the minimum by adopting specific shapes of the friction washers and/or the tubular stops.

BRIEF DESCRIPTION OF THE DRAWINGS

The present invention is illustrated in conjunction with the figures below in which.

DETAILED DESCRIPTION OF THE INVENTION

Figure 1:
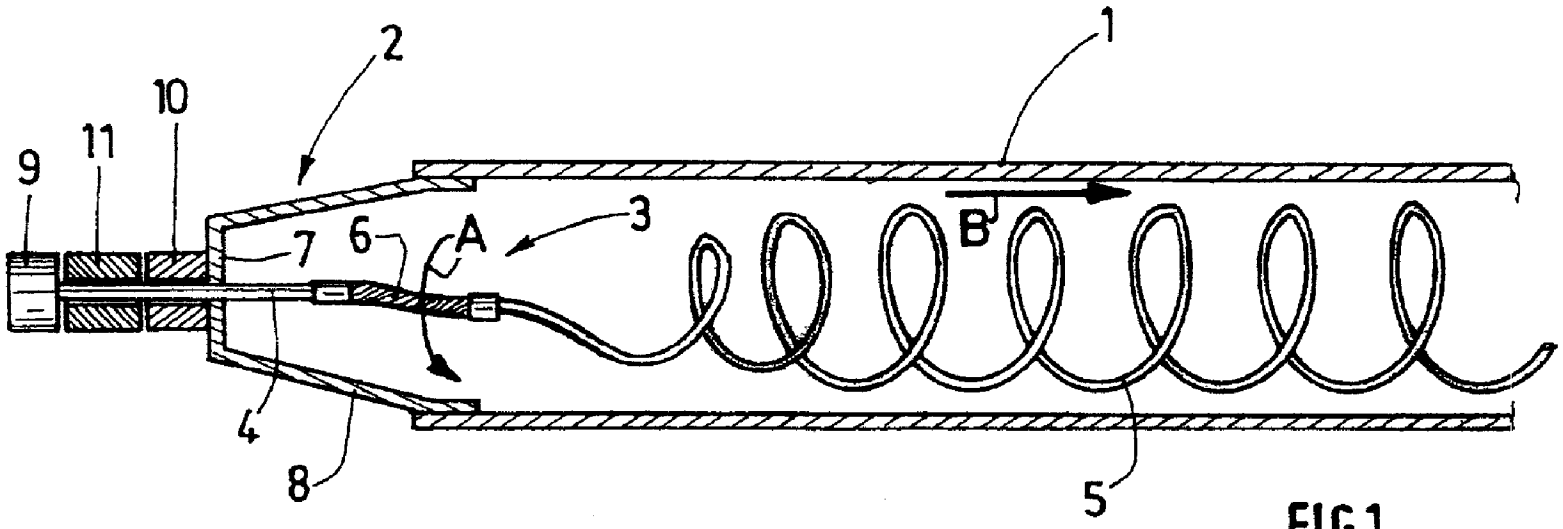
FIG. 1 shows a longitudinal cross section of a tube with a cleaning device according to the invention fixed to the upstream end of said tube.

FIG. 1 shows a fouling reducing device according to the invention with a mobile part 3 and a fixed part 2 fixed to the upstream end of a tube 1. Throughout the present application, the terms "upstream" and "downstream" are defined with regard to the flow direction of the fluid passing through the tube 1, represented by the arrow B. The fixed part 2 of the device has the shape of a yoke comprising a plate 7 drilled with a central orifice, and two branches 8, symmetrical to one another in principle with regard to the tube axis, whereof the ends bear against the inside wall of the tube. The fixed part further comprises a tubular stop 10 joined to the plate 7. The channel of said stop 10 is aligned with the orifice of the plate and forms therewith a single rather long channel which serves mainly to maintain the trunnion 4 in the axis of rotation of the mobile element 3. The mobile element 3 is mounted rotating freely in the fixed part 2. Said mobile element comprises, from the upstream end thereof, a stop 9, a trunnion 4 joined to the stop 9, a flexible connector 6 made from stainless steel cable, and finally, the helical part 5 rotated, in the direction of the arrow A, by the fluid flow. It may be observed that all the turns of the helix do not have the same size, but that the first two have a smaller outside diameter than that of the following turns. Furthermore, a friction washer 11 is provided between the stop 9 joined to the trunnion and the stop 10 joined to the yoke.

Figure 2:
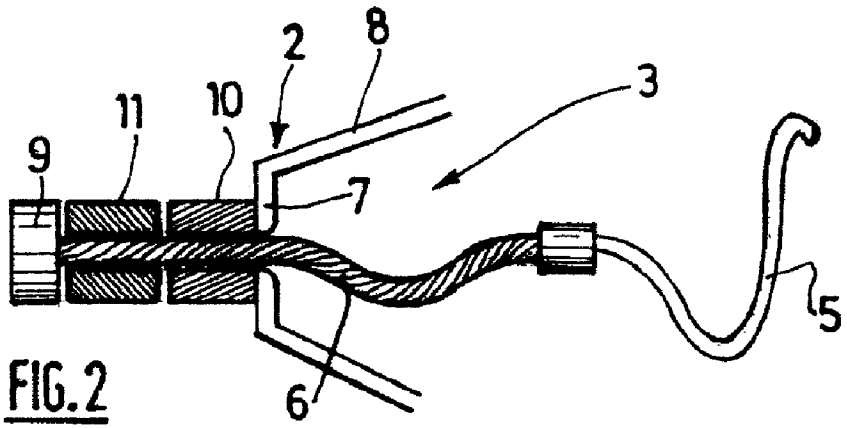
FIG. 2 shows a view of a specific embodiment of the device for fastening the mobile element in the tube.

FIG. 2 shows an enlargement of the upstream part of the device according to the present invention. The difference from FIG. 1 resides in the fact that the metal trunnion 4 is replaced by an extension of the flexible connector 6 whereof the downstream end is joined to the stop 9. Obviously, all possible configurations of the friction washer 11 and of the stop 20 described above, apply to this particular application of the present invention.

The invention is now illustrated with the help of the following exemplary embodiment.

EXAMPLE

To test the effectiveness of the device according to the invention, the Applicant has used the operating conditions of the heat exchanger of the example of application EP 1 227 292.

These conditions are as follows:

heat exchanger of a refinery which is used to heat, to 260° C., using a distillation residue, a light Arabian crude oil not stripped of its inorganic salts (no desalting);

inside diameter of the heat exchanger tubes: 20.2 mm; and length of the tubes: 6100 mm.

A fouling reduction device according to the present invention is installed in each of the 564 tubes. The mobile element of the fouling reduction device has a diameter of 1.2 mm and is made from an alloy containing 64.9% nickel, 8.75% molybdenum and 26.35% iron. The flexible connector used is a cable comprising 50 strands of stainless steel wound in the direction of rotation of the mobile element. The length of the flexible connector is 1.5 cm, and its diameter is 5 mm. The ratio of the outside diameter of the turns of the turbulence-generating element to the inside diameter of the tube is 0.65. The first three turns have a diameter smaller than that of the following turns. The ratio of the diameter of these first three turns to the inside diameter of the tube varies from 0.2 to 0.5.

Under the above conditions, the service life of more than 99% of the fouling reducing devices is lengthened from two years to four years. The service life of the fastening system of the fouling reducing device is therefore significantly improved. Moreover, traces of wear by friction observed on the inside wall of the tube are much less pronounced than those recorded with the fouling reducing devices of the prior art. The first turns show virtually no traces of wear on their outside portion.

The invention claimed is:

1. A device for reducing fouling in a tube (1) through which a fluid passes, said device comprising;

a mobile rotary element (3); and a fixed bearing-forming element (2) that is solidly connected to the upstream end of the tube (1), wherein:

the mobile rotary element (3) is connected to the fixed bearing-forming element (2) and comprises an upstream trunnion-forming part (4) and a downstream turbulence-generating part (5), shaped so as to be rotated by the fluid flowing in the tube (1), the upstream trunnion-forming part (4) and the downstream turbulence-generating part (5) are connected to one another by an elongate flexible connector (6) deformable along its whole length, fitted to permit damping of the dislodging force exerted by the mobile rotary element on the fixed bearing-forming element, and wherein the downstream turbulence-generating part forms a separate and distinct element from the elongate flexible connector, with one end of the elongate flexible connector being connected to the downstream turbulence generating part.

2. The device as claimed in claim 1, wherein the flexible connector (6) is a cable comprising braided or twisted strands, a chain or a ringed tube.

3. The device as claimed in claim 2, wherein the flexible connector (6) is made from one of metal, plastic, carbon fibers, synthetic fibers, elastomer, and a composite material comprising a combination of a plurality of these materials.

4. The device as claimed in claim 2, wherein the cable comprises a number of strands of 100 or less.

5. The device as claimed in any one of the preceding claims, wherein the length of the flexible connector (6) is between 1 cm and 5 cm.

6. The device as claimed in claim 1, wherein the diameter of the flexible connector is between 2 and 10 mm.

7. The device as claimed in claim 1, wherein the downstream turbulence-generating part (5) is helix shaped.

8. The device as claimed in claim 7, wherein the ratio of the outside diameter of the helix to the inside diameter of the tube is between 0.5 and 0.9.

9. The device as claimed in claim 7, wherein the outside diameter of the first turn or of the first turns of the helix is smaller than the outside diameter of the other turns of the helix.

10. The device as claimed in claim 9, wherein the ratio of the outside diameter of the first turn, or of the first turns, to the inside diameter of the tube, is between 0.1 and 0.6.

11. The device as claimed in claim 1, wherein the fixed bearing-forming element (2) is a cup-shaped yoke comprising a central part (7) drilled with an orifice for receiving the upstream trunnion-forming part (4) of the mobile rotary element (3), and two branches (8), symmetrical to one another, having a shape suitable for fixing them to the upstream end of the tube (1).

12. The device as claimed in claim 11, wherein a first stop (9) is provided at the end of the upstream trunnion-forming part (4) and in that a second tubular stop (10) is provided on the central part (7) of the yoke in a prolongation of the orifice suitable for receiving the upstream trunnion-forming part of the mobile rotary element, forming therewith a channel for maintaining the upstream trunnion-forming part.

13. A heat exchanger comprising a plurality of tubes (1) through which a fluid passes, wherein a fouling reducing device as claimed in claim 1, is fixed to the upstream end of at least one of said tubes.

14. The device as claimed in claim 3, wherein the metal is stainless steel.

15. The device as claimed in claim 4, wherein the number of strands is 50 or less.

16. The device as claimed in claim 5, wherein the length of the flexible connector is between 2 cm and 4 cm.

17. The device as claimed in claim 6, wherein the diameter of the flexible connector is between 4 and 8 mm.

18. The device as claimed in claim 8, wherein the ratio of the outside diameter of the helix to the inside diameter of the tube is between 0.6 and 0.8.

19. The device as claimed in claim 10, wherein the ratio of the outside diameter of the first turn, or of the first turns, to the inside diameter of the tube, is between 0.2 and 0.6.

20. The device as claimed in claim 1, wherein the elongate flexible connector, the upstream trunnion-forming part and the downstream turbulence-generating part form three separate, distinct elements, with one end of the elongate flexible connector being connected to the upstream trunnion-forming part and a second end of the elongate flexible connector being connected to the downstream turbulence-generating part.

* * * * *